US008596250B2

(12) United States Patent
Sugiura

(10) Patent No.: US 8,596,250 B2
(45) Date of Patent: Dec. 3, 2013

(54) CANISTER DEVICES FOR GAS VEHICLE

(75) Inventor: Masahiro Sugiura, Anjo (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 338 days.

(21) Appl. No.: 13/028,396

(22) Filed: Feb. 16, 2011

(65) Prior Publication Data

US 2011/0197861 A1 Aug. 18, 2011

(30) Foreign Application Priority Data

Feb. 17, 2010 (JP) ..... 2010-032096
Dec. 2, 2010 (JP) ..... 2010-269272

(51) Int. Cl.
*F02M 33/02* (2006.01)

(52) U.S. Cl.
USPC ..... 123/519; 123/520

(58) Field of Classification Search
USPC ..... 123/519, 518, 516, 520, 698; 137/587–589
See application file for complete search history.

(56) References Cited

U.S. PATENT DOCUMENTS

| | | | | |
|---|---|---|---|---|
| 5,170,765 | A * | 12/1992 | Hoshino et al. | 123/520 |
| 7,047,952 | B1 * | 5/2006 | Yamauchi et al. | 123/519 |
| 7,322,343 | B2 * | 1/2008 | Yamada et al. | 123/519 |
| 7,841,321 | B2 * | 11/2010 | Kosugi et al. | 123/519 |
| 2002/0020398 | A1 * | 2/2002 | Kimoto et al. | 123/519 |
| 2004/0173190 | A1 * | 9/2004 | Makino | 123/520 |
| 2006/0196480 | A1 * | 9/2006 | Kosugi et al. | 123/516 |

FOREIGN PATENT DOCUMENTS

JP 2006-138290 6/2006

* cited by examiner

*Primary Examiner* — Stephen K Cronin
*Assistant Examiner* — Joseph Dallo
(74) *Attorney, Agent, or Firm* — Ladas & Parry LLP

(57) ABSTRACT

A canister for a fuel vapor processor connected to a fuel tank and an engine includes a housing defining an adsorption chamber therein and an absorber being capable of adsorbing fuel vapor and filled in the adsorption chamber. The housing has an air communicating pipe communicating the adsorption chamber with the atmosphere, an introducing pipe communicating the adsorption chamber with the fuel tank and an exhaust pipe communicating the adsorption chamber with the engine. It is configured that airflow resistance in the canister along a first route between the air communicating pipe and the exhaust pipe is smaller than airflow resistance along a second route between the introducing pipe and the exhaust pipe.

6 Claims, 2 Drawing Sheets

CANISTER DEVICES FOR GAS VEHICLE

This application claims priority to Japanese Patent Application Serial Numbers 2010-269272 and 2010-032096, the contents of which are incorporated herein by reference.

BACKGROUND OF THE INVENTION

1. Field of the Invention

The present invention relates to canisters temporally trapping fuel vapor and being disposed on gasoline vehicles or the like.

2. Description of the Related Art

A gas vehicle is generally equipped with a fuel vapor processor for preventing fuel vapor vaporized in a fuel tank from flowing into the atmosphere. The fuel vapor processor includes a canister filled with an adsorbent and temporally trapping the fuel vapor by adsorbing the fuel vapor onto the adsorbent. As for a conventional canister shown in Japanese Laid-Open Patent Publication No. 2006-138290, the canister has a housing provided with an introducing pipe, an air communicating pipe and an exhaust pipe. The introducing pipe is connected to a fuel tank via a solenoid valve, which can prevent communication between the canister and the fuel tank. The air communicating pipe communicates the canister with the atmosphere. The exhaust pipe is connected to an engine via a vacuum switching valve, which can prevent communication between the engine and the canister. The solenoid valve and the vacuum switching valve are controlled by an electric control unit (ECU).

The housing of the canister has a partition for preventing gas from flowing in the canister along a shortcut route between introducing pipe and the exhaust pipe. The housing divides its inner space into a first adsorption chamber including a first and a second compartments, and a second adsorption chamber. The first adsorption chamber communicates with the second adsorption chamber, a first compartment and a second compartment, which directly communicate with the air communicating pipe, the introducing pipe and the exhaust pipe, respectively. The first and the second adsorption chamber and the second compartment are filled with activated carbons as adsorbent, whereas the first compartment is empty.

The activated carbon filled in the second compartment is composed of a crushed activated carbon, and the first and the second adsorption chamber are filled with a granulated activated carbon having a larger diameter than the crushed activated carbon.

When refueling the fuel tank, the solenoid valve is opened, and then the fuel gas including fuel vapor and air in the fuel tank flows through the introducing pipe and the first compartment and into the first adsorption chamber. Most of the fuel vapor in the fuel gas adsorbs onto the activated carbon in the first adsorption chamber, whereas the fuel vapor that is not trapped in the first adsorption chamber flows into the second adsorption chamber and then is trapped by the activated carbon in the second adsorption chamber. The remaining air flows through the second adsorption chamber and the air communicating pipe and then into the atmosphere.

During driving or in a high pressure condition of the fuel tank, the fuel gas generated in the fuel tank flows through the introducing pipe, the first compartment, the second compartment, the exhaust pipe and the vacuum switching valve and then into the engine. In such condition, ambient air flows through the air communicating pipe and into the canister so that the fuel vapor adsorbed onto the activated carbons in the canister are detached from the activated carbon and flows into the engine (so-called purge operation).

Because the first compartment is empty, airflow resistance (pressure drop) in the canister on a first route between the air communicating pipe and the exhaust pipe is larger than one on a second route between the introducing pipe and the exhaust pipe. Therefore, the amount of gas flowing in the canister along the second route is likely to be larger than the amount of gas flowing along the first route during the purge operation. Thus, there is a need for improved canisters.

SUMMARY OF THE INVENTION

It is, accordingly, one object of the present teachings to provide improved canisters.

In one aspect of the present teachings, a canister for a fuel vapor processor connected to a fuel tank and an engine includes a housing defining an adsorption chamber therein and an absorber being capable of adsorbing fuel vapor and filled in the adsorption chamber. The housing has an air communicating pipe communicating the adsorption chamber with the atmosphere, an introducing pipe communicating the adsorption chamber with the fuel tank and an exhaust pipe communicating the adsorption chamber with the engine. It is configured that airflow resistance in the canister along a first route between the air communicating pipe and the exhaust pipe is smaller than airflow resistance along a second route between the introducing pipe and the exhaust pipe.

In accordance with this aspect, because the airflow resistance on the first route from the air communicating pipe to the exhaust pipe in the canister is smaller than that of the second route from the introducing pipe to the exhaust pipe, the amount of gas flowing into the canister from the air communicating pipe is likely to be larger than that of gas flowing from the introducing pipe during purge operation. Therefore, it is able to prevent the larger amount of denser fuel vapor vaporized in the fuel tank from flowing into the engine through the canister, thereby inhibiting disturbance of air-fuel ratio (A/F) in the engine.

Other objects, features and advantage of the present invention will be ready understood after reading the following detailed description together with the accompanying drawings and the claims.

DETAILED DESCRIPTION OF THE INVENTION

Each of the additional features and teachings disclosed above and below may be utilized separately or in conjunction with other features and teachings to provide improved canisters. Representative examples of the present invention, which examples utilized many of these additional features and teachings both separately and in conjunction with one another, will now be described in detail with reference to the attached drawings. This detailed description is merely intended to teach a person of skilled in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Figure 1:
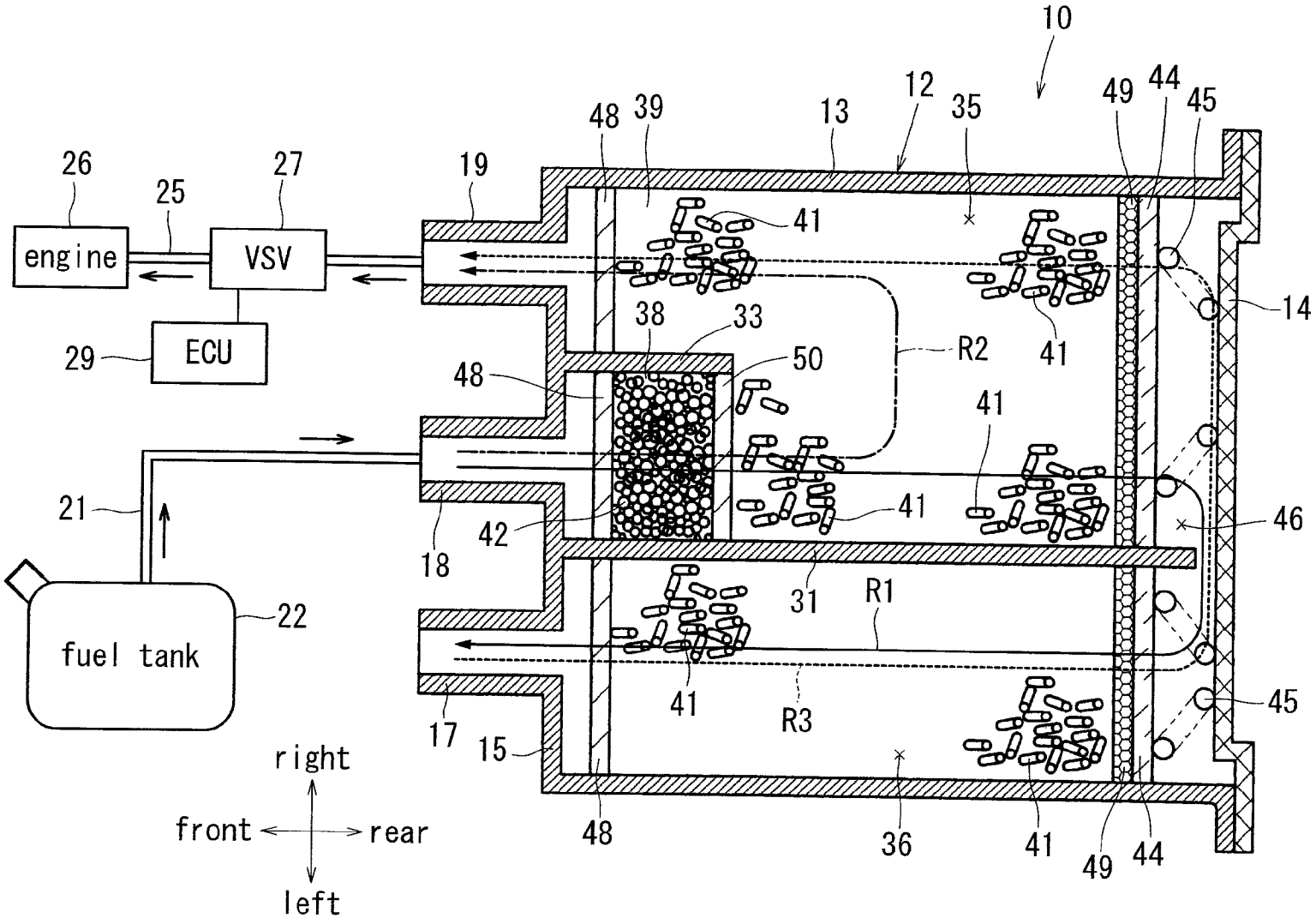
FIG. 1 is a schematic view of a fuel vapor processor including a horizontal, cross-sectional view of a canister of the present teachings.

A first embodiment will be described. FIG. 1 is schematic view of a fuel vapor processor including a horizontal cross-sectional view of a canister 10. The canister of this embodiment is configured to be mounted on gasoline vehicle such as automobile. For convenience of explanation as for the canister 10, left, right, lower and upper directions in FIG. 1 are defined as front, rear, left and right directions, respectively.

As shown in FIG. 1, the canister 10 has a housing 12 in a box shape. The housing 12 is made from a resin and has a housing body 13, which is formed in a hollow cylindrical shape with a bottom, and a lid 14 capable of closing an open end of the housing body 13. In this embodiment, the bottom of the housing body 13 is positioned at the front side (left side in FIG. 1), whereas the lid 14 is positioned at the rear side (right side in FIG. 1).

The housing body 13 has three pipes 17, 18 and 19 extending forwardly from a bottom plate 15 of the housing body 13. Left one of the pipes is an air communicating pipe 17, which is communicated with the atmosphere, i.e., ambient air outside the canister, etc. Center one of the pipes is an introducing pipe 18 communicating with an upper portion of a fuel tank 22 via a fuel vapor pathway 21. The upper portion of the fuel tank 22 contains a vaporized gas and not liquid fuel. Right one of the pipes is an exhaust pipe 19 communicating with an engine 26 via a purge pathway 25. In the purge pathway 25, a vacuum switching valve (VSV) 27 for opening and closing the purge pathway 25. The vacuum switching valve 27 is controlled by an electric control unit (ECU) 29. Here, "fuel vapor processor" is composed of the canister 10, the fuel vapor pathway 21, the purge pathway 25, the vacuum switching valve 27 and the ECU 29, etc.

The housing body 13 has a first partition plate 31 (at left side) and a second partition plate 33 (at right side), which are formed integrally with the bottom plate 15 of the housing body 13. The first partition plate 31 extends near the lid 14. The first partition plate 31 divides an inner space of the housing body 13 into a first adsorption chamber 35, which communicates with the introducing pipe 18 and the exhaust pipe 19, and a second adsorption chamber 36 communicating with the air communicating pipe 17. The first partition plate 31 is longer than the second partition plate 33, in particular, the first partition plate 31 is about four times as long over the second partition plate 33 in this embodiment (refer to FIG. 1). The second partition plate 33 divides a front inner area of the first adsorption chamber 35 into a first compartment 38 directly communicating with the introducing pipe 18 and a second compartment 39 directly communicating with the exhaust pipe 19.

The first adsorption chamber 35 and the second adsorption chamber 36 are filled with particle activated carbon 41 as adsorbent capable of adsorbing fuel vapor generated in the fuel tank 22. The first compartment 38 is filled with particle activated carbon 42 having smaller diameter than the activated carbon 41 contained in the first adsorption chamber 35. Here, particle activated carbon is generally classified into a crushed activated carbon and a granulated activated carbon. The crushed carbon has a particle diameter between 0.7 mm to 2.0 mm, whereas the granulated carbon has a particle diameter between 2.0 mm to 2.5 mm. Thus, the activated carbon 41 consists of the granulated carbon, whereas the activated carbon 42 consists of the crushed carbon having smaller diameter than the granulated carbon. Accordingly, pressure drop (airflow resistance) of the fuel gas (gas containing fuel vapor) flowing through the first compartment 38 filled with the crushed carbon is larger than that of the fuel gas flowing though the first and second adsorption chambers 35 and 36 filled with the granulated carbon.

At rear sides of the first and the second adsorption chambers 35 and 36, plates 44 are disposed for pressing the activated carbons 41 contained in the first and the second adsorption chambers 35 and 36, respectively. The plates 44 are formed in a grid shape with air permeability and are provided movably forward and backward (in left and right directions in FIG. 1). Between each of the plates 44 and the lid 14, a spring 45 is disposed. The spring 45 elastically biases the corresponding plate 44 toward the activated carbon 41. In addition, between the plates 44 and the lid 14, a communication pathway 46 is formed such that the first adsorption chamber 35 and the second adsorption chamber 36 are communicated with each other via the communication pathway 46.

Between the bottom plate 15 of the housing body 13 and the activated carbons 41 and 42 in the first and the second adsorption chambers 35 and 36 and the first compartment 38, first filters 48 made of a non-woven fabric or the like are provided, respectively. Between the activated carbon 41 in the first and the second adsorption chambers 35 and 36 and the plates 44, second filters 49 made of urethane foam or the like are provided, respectively. In addition, between the activated carbon 41 in the first adsorption chamber 35 and the activated carbon 42 in the first compartment 38, a third filter 50 made of a non-woven fabric or the like is provided.

As for this canister 10, when refueling into the fuel tank 22, fuel gas including fuel vapor vaporized in the fuel tank 22 flows though the fuel vapor pathway 21, the introducing pipe 18 of the housing 12, the first compartment 38, the first adsorption chamber 35, the communication pathway 46, and the second adsorption chamber 36 (indicated by an arrow R1 in FIG. 1). During flowing, most of the fuel vapor in the fuel gas adsorb onto the activated carbon 42 in the first compartment 38 and the activated carbon 41 in the first adsorption chamber 35, and remaining fuel vapor adsorbs onto the activated carbon 41 in the second adsorption chamber 36. Thus, air not including fuel vapor is finally released into the atmosphere through the air communicating pipe 17. Here, fuel gas consists of mixed gas composed of fuel vapor (mainly, hydrocarbon compounds) and air.

The vacuum switching valve 27 is opened during driving and purge operation in a high pressure condition of the fuel tank 22. Thus, negative pressure in the engine 26 influences the inner space of the housing 12 through the purge pathway 25 and the exhaust pipe 19. Accordingly, the fuel gas in the fuel tank 22 flows through the fuel vapor pathway 21, the introducing pipe 18 of the housing 12, the first compartment 38, the first adsorption chamber 35, and the exhaust pipe 19, sequentially (refer to an arrow R2 in FIG. 1). In addition, air flows through the air communicating pipe 17 of the housing 12, the second adsorption chamber 36, the communication pathway 46, the first adsorption chamber 35 and the exhaust pipe 19 (refer to an arrow R3 in FIG. 1). The fuel vapor adsorbed on the activated carbons 41 and 42 is removed (purged) and flowed through the purge pathway 25 and into the engine 26 due to the fuel gas flow (R2 in FIG. 1) and the air flow (R3 in FIG. 1). The vacuum switching valve 27 is opened and closed depending on operating condition of the ECU 29.

In the canister 10, the airflow resistance on a first route between the air communicating pipe 17 and the exhaust pipe 19 is smaller than one on a second route between the introducing pipe 18 and the exhaust pipe 19. Therefore, suction power, which is generated by the negative pressure in the engine 26, at the air communicating pipe 17 is larger than one at the introducing pipe 18 during purge operation, so that it is able to suppress suction power affecting on the fuel tank 22. Accordingly, it is able to prevent dense fuel vapor vaporized in the fuel tank 22 from flowing into the engine 26 during the purge operation, thereby preventing disturbance of air-fuel ration (A/F) in the engine 26. When providing the canister 10 to a fuel vapor processor, a solenoid valve for opening and closing the fuel vapor pathway 21 in order to control gas-flow in the fuel vapor pathway 21 can be omitted.

The first compartment 38 contains the activated carbon 42 having smaller diameter than the activated carbon 41 filled in the first adsorption chamber 35. This configuration can easily make the airflow resistance on the first route between the air communicating pipe 17 and the exhaust pipe 19 smaller than one on the second route between the introducing pipe 18 and the exhaust pipe 19.

The housing 12 has the second partition plate 33 separating the first compartment 38 close to the introducing pipe 18 from the second compartment 39 close to the exhaust pipe 19. Therefore, the second partition plate 33 inhibits in the canister 10 from the introducing pipe 18 to the exhaust pipe 19.

The third filter 50 is provided between the activated carbon 41 contained in the first adsorption chamber 35 and the activated carbon 42 having smaller diameter than the activated carbon 41. Therefore, it is able to separately keep the activated carbons 41 and 42, which have diameters different from each other.

The granulated activated carbon 41 is used as adsorbent in the first adsorption chamber 35 and the crushed activated carbon 42 is used as adsorbent having smaller diameter than the granulated activated carbon 41. Therefore, use of granulated activated carbon 41 and the crushed activated carbon 42 can easily make the airflow resistance on the first route between the air communicating pipe 17 and the exhaust pipe 19 smaller than one on the second route between the introducing pipe 18 and the exhaust pipe 19.

When the first adsorption chamber 35 contains heat storage materials capable of absorbing and releasing heat depending on temperature alteration, it is able to suppress temperature increase and decrease caused by adsorption and dissociation of the fuel vapor due to latent heat of the heat storage material. Any phase-change materials capable of absorbing and releasing heat depending on temperature alteration can be used as heat storage material, in particular, such phase-change materials, microcapsules sealingly containing the phase-change materials, and pellets sealingly containing the microcapsules or the phase-change materials or the like can be used. It is able to utilize various shapes and arrangements of the phase-change materials, in particular, it is preferable to mix crushed heat storage material with the activated carbon 41 in the first adsorption chamber 35. As for the phase-change material, for example, paraffin such as heptadecane and octadecane having melting points of 22° C. and 28° C., respectively, can be used. In addition, it is also preferable to mix the heat storage material with the activated carbon 41 in the first compartment 38.

Figure 2:
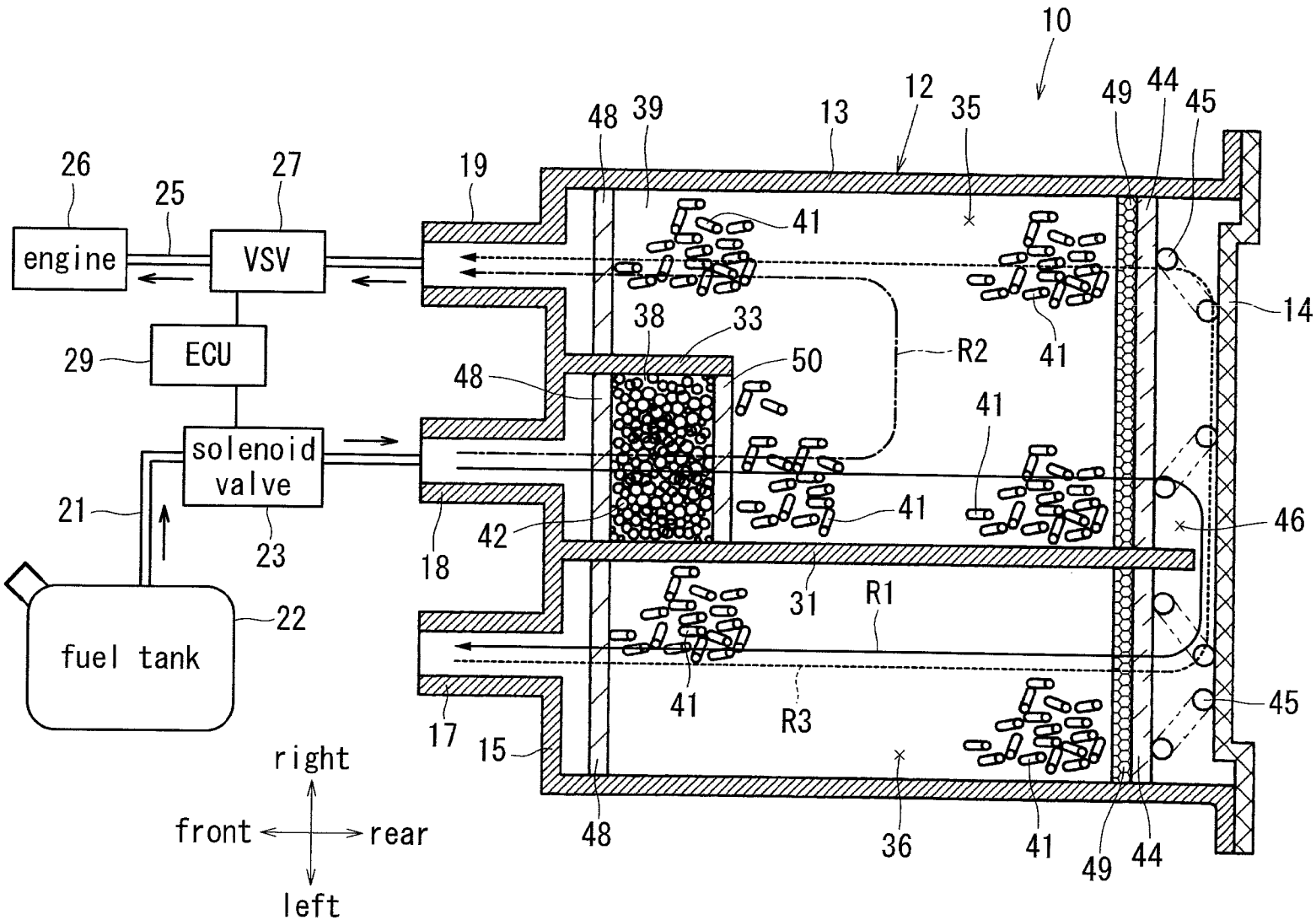
FIG. 2 is a schematic view of another fuel vapor processor including a horizontal, cross-sectional view of the canister of the present teachings.

A second embodiment of the present teachings will be described. The second embodiment corresponds to the first embodiment further including some modifications. Thus, only the modifications will be described and the same configurations will not be descried. FIG. 2 is schematic view of a fuel vapor processor including a horizontal cross sectional view showing the canister 10 in the second embodiment.

This embodiment includes a solenoid valve, which is omitted in the first embodiment. That is, a solenoid valve 23 opening and closing the fuel vapor pathway 21 is disposed in the fuel vapor pathway 21 as shown in FIG. 2. The solenoid valve 23 is controlled by the ECU 29. In general, the solenoid valve 23 is opened during refueling, driving, purging in high pressure condition of the fuel tank 22 and the like, whereas the solenoid valve 23 is closed in other conditions. The ECU 29 opens and closes the solenoid valve 23 depending on operating condition, pressure state in the fuel tank 22 and the like In other embodiments, other materials capable of adsorbing and releasing fuel vapor can be used as adsorbent instead of activated carbon 41 and 42. The right partition 33 of the housing 12 can be omitted. Similarly, the third filter 50 can be omitted.

The invention claimed is:

1. A canister for a fuel vapor processor connected to a fuel tank and an engine, comprising:

a housing defining an adsorption chamber therein and having an air communicating pipe communicating the adsorption chamber with the atmosphere, an introducing pipe communicating the adsorption chamber with the fuel tank and an exhaust pipe communicating the adsorption chamber with the engine; and an absorber being capable of adsorbing fuel vapor and filled in the adsorption chamber, wherein airflow resistance in the canister along a first route between the air communicating pipe and the exhaust pipe is smaller than airflow resistance along a second route between the introducing pipe and the exhaust pipe.

2. A canister as defined in claim 1, wherein the adsorption chamber is divided into a main adsorption chamber and a compartment positioned near the introducing pipe, wherein the absorber is composed of a first adsorbent filled in the main adsorption chamber and a second adsorbent filled in the compartment, and wherein the second adsorbent has a smaller diameter than the first adsorbent.

3. A canister as defined in claim 2, wherein the housing comprises a partition partially dividing the compartment from the main adsorption chamber.

4. A canister as defined in claim 2, further comprising a filter disposed between the first adsorbent and the second adsorbent.

5. A canister as defined in claim 2, wherein the first adsorbent is composed of a granulated activated carbon, and wherein the second adsorbent is composed of a crushed activated carbon.

6. A canister as defined in claim 2, further comprising a heat storage material absorbing and release heat depending on heat alteration and disposed in the adsorption chamber.

* * * * *